US007735336B2

(12) United States Patent
Williams

(10) Patent No.: US 7,735,336 B2
(45) Date of Patent: Jun. 15, 2010

(54) LOCKING MECHANISM FOR MAGNETIC CONNECTOR ASSEMBLY USED WITH AN ORNAMENTAL ACCESSORY

(75) Inventor: Clara R. Williams, Chicago, IL (US)

(73) Assignee: Clara Belle Collections, LLC, Chicago, IL (US)

( * ) Notice: Subject to any disclaimer, the term of this patent is extended or adjusted under 35 U.S.C. 154(b) by 634 days.

(21) Appl. No.: 11/249,771

(22) Filed: Oct. 13, 2005

(65) Prior Publication Data

US 2006/0086144 A1 Apr. 27, 2006

Related U.S. Application Data

(63) Continuation-in-part of application No. 10/746,679, filed on Dec. 26, 2003, now abandoned.

(51) Int. Cl.

| | |
|---|---|
| ***A44C 5/00*** | (2006.01) |
| ***A44C 25/00*** | (2006.01) |
| ***A44C 15/00*** | (2006.01) |
| ***A44B 21/00*** | (2006.01) |

(52) U.S. Cl. ..... 63/3; 63/35; 63/900; 63/18; 63/40; 63/19; 24/303

(58) Field of Classification Search ..... 63/35, 63/3, 900, 18, 40, 19; 24/303
See application file for complete search history.

(56) References Cited

U.S. PATENT DOCUMENTS

| | | | | |
|---|---|---|---|---|
| 1,807,293 | A * | 5/1931 | Keller | 24/616 |
| 2,615,227 | A | 10/1952 | Hornik | |
| 2,637,887 | A | 5/1953 | Goodman et al. | |
| 3,129,477 | A * | 4/1964 | Mizuno | 24/303 |
| 3,263,444 | A | 8/1966 | Croce | |
| 4,530,221 | A * | 7/1985 | Weinberg | 63/3.2 |
| 5,008,984 | A * | 4/1991 | Levy | 24/303 |
| 5,050,276 | A * | 9/1991 | Pemberton | 24/303 |
| 5,099,659 | A | 3/1992 | Carranza et al. | |

(Continued)

FOREIGN PATENT DOCUMENTS

| | | |
|---|---|---|
| EP | 0 105 995 A1 | 4/1984 |

OTHER PUBLICATIONS

Arizona Bead Company Incorporated, "Magnetic Clasps," printed Dec. 9, 2003, 2 pages, printed from www.arizonabeadcompany.com; Arizona Bead Company; Tempe, Arizona.

(Continued)

*Primary Examiner*—Victor Batson
*Assistant Examiner*—David Reese
(74) *Attorney, Agent, or Firm*—Ryndak & Suri LLP

(57) ABSTRACT

A locking mechanism for jewelry, purses and other accessories is provided. The locking mechanism comprises first and second magnetically attracted surfaces and a collar. The second magnetically attracted surface is adapted for magnetic coupling to the first magnetically attracted surface. The collar is hingeably coupled to either the first or second magnetically attracted surfaces and is operable between an open position and a closed position. When the first and second magnetically attracted surface are magnetically coupled one to the other, and the collar is in the closed position, at least a portion of the collar surrounds a perimeter of the first and second magnetically attracted surfaces.

12 Claims, 3 Drawing Sheets

U.S. PATENT DOCUMENTS

| | | | | | |
|---|---|---|---|---|---|
| 5,195,335 | A | | 3/1993 | Hart | |
| 5,197,168 | A | * | 3/1993 | Levy | 24/303 |
| 5,214,940 | A | * | 6/1993 | Capifali | 63/21 |
| 5,311,647 | A | | 5/1994 | Levy | |
| 5,317,789 | A | * | 6/1994 | Levy | 24/303 |
| 5,349,725 | A | * | 9/1994 | Levy | 24/303 |
| 5,367,891 | A | | 11/1994 | Furuyama | |
| 5,432,986 | A | | 7/1995 | Sexton | |
| 5,535,603 | A | | 7/1996 | Hayakawa | |
| 5,572,887 | A | | 11/1996 | Geswelli | |
| 5,669,242 | A | | 9/1997 | Cayton | |
| 5,722,260 | A | * | 3/1998 | Mangano | 63/3.1 |
| 5,806,346 | A | | 9/1998 | Schlinger et al. | |
| 5,845,373 | A | | 12/1998 | Langer | |
| 6,233,971 | B1 | | 5/2001 | Ohlund | |
| 6,282,760 | B1 | | 9/2001 | Mars | |
| 6,381,985 | B1 | | 5/2002 | Burgard | |
| 6,427,486 | B1 | | 8/2002 | Yellen | |
| 6,484,536 | B1 | | 11/2002 | Gould | |
| 6,578,981 | B2 | | 6/2003 | Jackson et al. | |
| 6,591,462 | B2 | * | 7/2003 | Fuhrman | 24/303 |
| 6,604,381 | B2 | | 8/2003 | Haber | |
| 6,612,130 | B2 | | 9/2003 | Ito | |
| 6,640,398 | B2 | * | 11/2003 | Hoffman | 24/303 |
| 7,073,232 | B1 | * | 7/2006 | Fuhrman et al. | 24/303 |
| 7,334,433 | B1 | * | 2/2008 | Fuhrman et al. | 63/3.1 |
| 2002/0083737 | A1 | | 7/2002 | Esposito, Jr. | |
| 2002/0148251 | A1 | | 10/2002 | Plumly | |
| 2004/0011079 | A1 | | 1/2004 | Rose | |
| 2004/0200236 | A1 | | 10/2004 | Emberson et al. | |
| 2004/0244419 | A1 | | 12/2004 | Suzuki | |

OTHER PUBLICATIONS

Magnetic Arts, "Magnetic Clasps for Health Jewelry," printed Dec. 18, 2003, 2 pages, printed from www.advancedrecording.com, Magnetic Arts, Escondido, California.

* cited by examiner

LOCKING MECHANISM FOR MAGNETIC CONNECTOR ASSEMBLY USED WITH AN ORNAMENTAL ACCESSORY

CROSS-REFERENCE TO RELATED APPLICATIONS

This is a continuation-in-part application of U.S. patent application Ser. No. 10/746,679, filed Dec. 26, 2003 now abandoned.

TECHNICAL FIELD

The present invention relates to accessories such as jewelry, purses and the like, and more particularly to a locking mechanism for a magnetic connector used to couple removable segments of jewelry.

BACKGROUND OF THE INVENTION

Jewelry is considered desirable but is often expensive. People wish to have multiple pieces of jewelry to wear with different outfits and for different occasions. Typically, jewelry cannot be recast or modified. Importantly, the decorative portion of jewelry cannot be easily altered or substituted. For example, a beaded necklace with a diamond pendant may be beautiful, but not be very versatile. A need exists for a jewelry assembly that contains a removable portion to permit the interchange of various jewelry sub-components.

In order for a removable portion to be practical, it must be easy to attach and detach. It is known to use a mechanical clasp to secure a piece of jewelry on a person. It is also known to use magnets to clasp opposing ends of a jewelry chain together. For example, U.S. Pat. No. 6,640,398 to Hoffman discloses using magnets displaced in channels on opposed ends of a single piece of jewelry. In Hoffman, the magnets help clasp a single piece of jewelry together. However, nothing in Hoffman discloses a removable jewelry portion or attaching a removable jewelry portion to a receiving jewelry portion with magnets. A need exists for a jewelry assembly that contains an easily attachable removable portion. A need also exists for a jewelry assembly that uses magnets to attach a removable portion.

The present invention is provided to solve the problems discussed above and other problems, and to provide advantages and aspects not previously provided. A full discussion of the features and advantages of the present invention is deferred to the following detailed description, which proceeds with reference to the accompanying drawings.

SUMMARY OF THE INVENTION

The present invention is a jewelry apparatus with a removable portion. The removable portion is attached to a receiving portion using magnets. By use of magnets, the removable portion can be easily attached and detached. The invention permits a person to swap between multiple removable portions onto a single receiving portion. By doing so, a person will be able to transform a smaller jewelry collection into a seemingly larger one.

In accordance with one aspect of the present invention, a jewelry assembly is provided. The jewelry assembly has a receiving segment with a first and a second end; and a removable segment with a first and a second end. The first and second ends of the receiving segment each have a magnetically attracted surface. The first end and the second end of the removable segment each have a magnetically attracted surface. The first and second ends of the receiving segment are removably joined to the respective first and second ends of the removable segment by the magnetically attracted surfaces.

According to another aspect of the present invention, a necklace assembly is provided. The necklace assembly comprises a first segment having opposed ends; a second segment having opposed ends; a first connection assembly; and a second connection assembly. Both the first and second connection assemblies each have at least two magnets. The two magnets of the first connection assembly removably join a first end of the first segment with a first end of the second segment. The two magnets of the second connection assembly removably join a second end of the first segment with a second end of the second segment.

According to yet another aspect of the present invention, a removable segment of a necklace assembly is provided. The removable segment comprises a first end; a second end; and an ornamental portion positioned between the first and second ends. The first end has a magnet that removably connects to a first end of a receiving segment of a necklace assembly. The second end has a magnet that removably connects to a second end of the receiving segment of a necklace assembly.

According to still another aspect of the present invention, a locking mechanism for jewelry, purses and other accessories is provided. The locking mechanism comprises first and second magnetically attracted surfaces and a collar. The second magnetically attracted surface is adapted for magnetic coupling to the first magnetically attracted surface. The collar is hingeably coupled to either the first or second magnetically attracted surfaces and is operable between an open position and a closed position. When the first and second magnetically attracted surface are magnetically coupled one to the other, and the collar is in the closed position, at least a portion of the collar surrounds a perimeter of the first and second magnetically attracted surfaces.

According to still another aspect of the present invention, an accessory assembly with a connector locking mechanism is provided. The accessory assembly includes a bag having a first connection point and a first magnetically attracted surface attached to the connection point. The accessory assembly further includes a strap having a first end and a second end. A second magnetically attracted surface is attachably connected proximate either the first or second end of the strap. The second magnetically attracted surface is adapted for magnetic coupling to the first magnetically attracted surface. The accessory assembly also has a collar hingeably coupled to either the first or second magnetically attracted surface. The collar is operable between an open position and a closed position. When the first and second magnetically attracted surfaces are magnetically coupled one to the other, and the collar is in the closed position, at least a portion of the collar surrounds a perimeter of the first and second magnetically attracted surfaces.

According to yet another aspect of the present invention, an ornamental brooch with a connector locking mechanism is provided. The brooch has a first connection point provided for removably attaching the brooch to a connector. The brooch also includes a first connector and a second connector. The first connector is provided for removable attachment of the brooch to an object. The second connector is comprised of a first magnetically attracted surface. The second connector is removably attached to the first connection point and is adapted for magnetic coupling to a second magnetically attracted surface. The brooch further includes a collar hingeably coupled to the second connector. The collar is operable between an open position and a closed position. When the second connector is magnetically coupled to a second magnetically attracted surface, and the collar is in the closed position, at least a portion of the collar surrounds a perimeter of the second connector and the second magnetically attracted surface.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
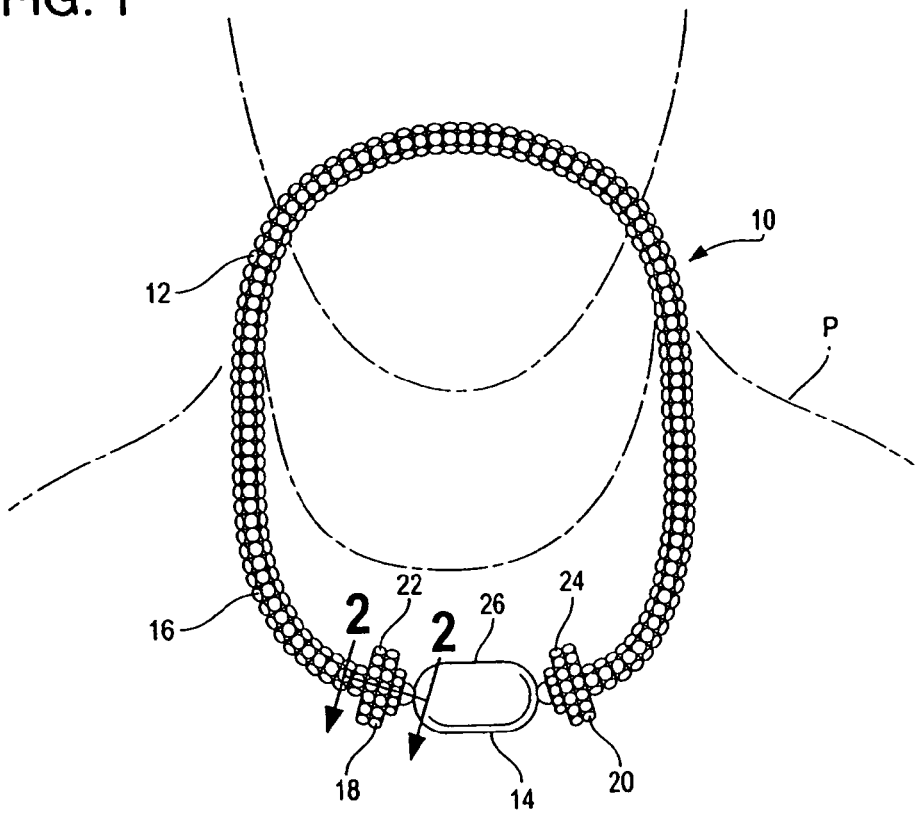
FIG. 1 is a perspective view of a necklace of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
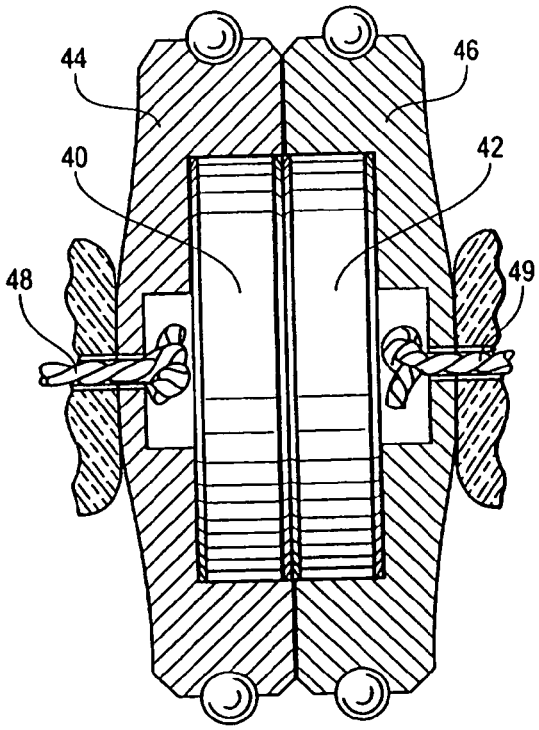
FIG. 2 is a sectional view of the magnetic connection assembly of the present invention taken along line 2-2 of FIG. 1.
Figure 3:
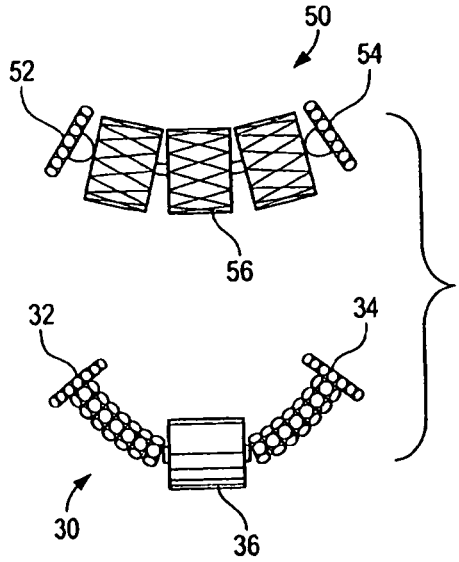
FIG. 3 is a perspective view of two removable segments of the present invention.

As shown in FIGS. 1-3, a jewelry assembly is provided. The present invention is preferably used with necklaces, although it can also be used with bracelets, anklets, earrings and other items of jewelry. The length of the jewelry assembly determines whether a particular assembly is suited to be used as a necklace, bracelet or other item. By jewelry, applicant is also including belts with removable buckles, and the present invention is easily adaptable to be used with belts.

Referring to FIG. 1, jewelry assembly 10 is shown on person P. Jewelry assembly 10, in this case a necklace assembly, includes receiving segment 12 and removable segment 14.

Receiving segment 12 is typically a flexible curvilinear item. It can be made of cord, thread, metal (i.e., gold or silver) or any other material as known to those in the art. As illustrated in FIG. 1, ornament designs such as beads 16 can be part of receiving segment 12. Preferably, receiving segment 12 is continuous and uninterrupted.

Receiving segment 12 has a first end 18 and a second end 20. In the illustrated embodiment, first end 18 and second end 20 appear in the form of portions of a bead. At first end 18 and second end 20, there is a magnetically attracted surface such as a magnet.

In FIG. 1, removable segment 14 is removably joined to receiving segment 12. Removable segment 14 has a first end 22 and a second end 24. In the illustrated embodiment, first end 22 and second end 24 appear in the form of complementary portions of the beads from ends 18 and 20. At first end 22 and second end 24, there is a magnetically attracted surface such as a magnet. Removable segment 14, in one embodiment, includes a decorative element 26 such as a precious or semi-precious stone, pendant or other jewel or item. Decorative element 26 is positioned between opposed ends 22 and 24.

First and second ends 18 and 20 are capable of being joined (and subsequently detached) to first and second ends 22 and 24 respectively by the magnetically attracted surfaces. When joined, the jewelry assembly looks seamless and as if it was one integral piece to a casual viewer. As shown in FIG. 2, magnet 40 attaches to magnet 42. The magnets may physically touch each other or at least be sufficiently close (i.e., a thin film may be separating the magnets) to keep the segments joined to each other. Magnet 40 is within housing 44 and magnet 42 is within housing 46, which may be a mirror-image of housing 44. Magnets 40 and 42 are connected to cords 48 and 49, respectively, of the removable segment. Magnets 40 and 42 may have a circular, square, rectangular, triangular or other fixed cross-sectional shape. Magnets 40 and 42 may be of identical shape and dimensions. The magnetically attractive surfaces of the receiving segment are cooperatively dimensioned to mate with the magnetically attractive surfaces of the removable segment.

The magnetically attractive surfaces of the receiving segment may be set such that one of them is of positive polarity and one of them is of negative polarity. Similarly, the magnetically attractive surfaces of the removable segment may be set such that one of them is of positive polarity and one of them is of negative polarity. In this configuration, the magnetically attractive portions of the removable segment may connect to each other and form a smaller necklace, bracelet, anklet or other jewelry. Along the same lines, the magnetically attractive portions of the receiving segment may connect to each other to form a bracelet or anklet. The polarity of the magnetically attractive surfaces may be set up such that the removable segment must align with the receiving segment in a way that the decorative element is always facing out from the wearer. Said another way, the polarity of the magnetically attractive surfaces of the removable segment would only join with the receiving segment while the decorative element was facing the right direction.

Alternatively, both ends of the receiving segment may be of one polarity while both ends of the removable segment may be of the other polarity. In such a setup, the receiving segment and the removable segment cannot close on themselves because both ends of each segment contain magnets of the same polarity. However, it would be possible for a person to mistakenly connect the removable segment to the receiving segment with any decorative element facing the wrong direction.

Figure 4:
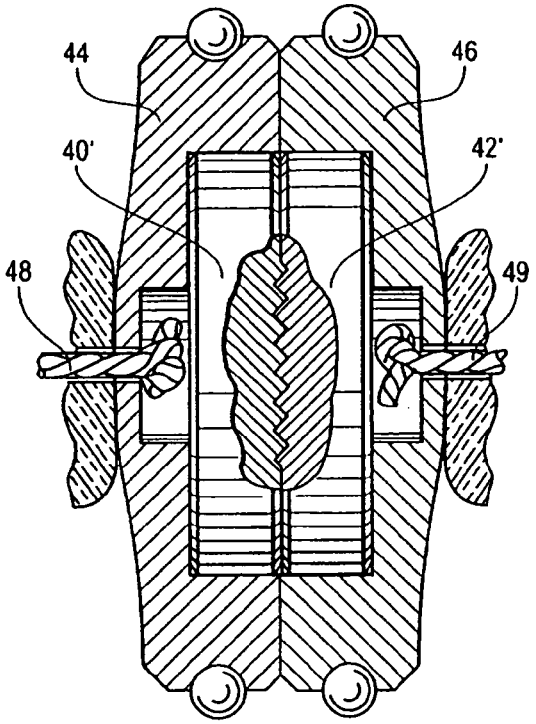
FIG. 4 is a sectional view of an alternative embodiment of the present invention.
Figure 5:
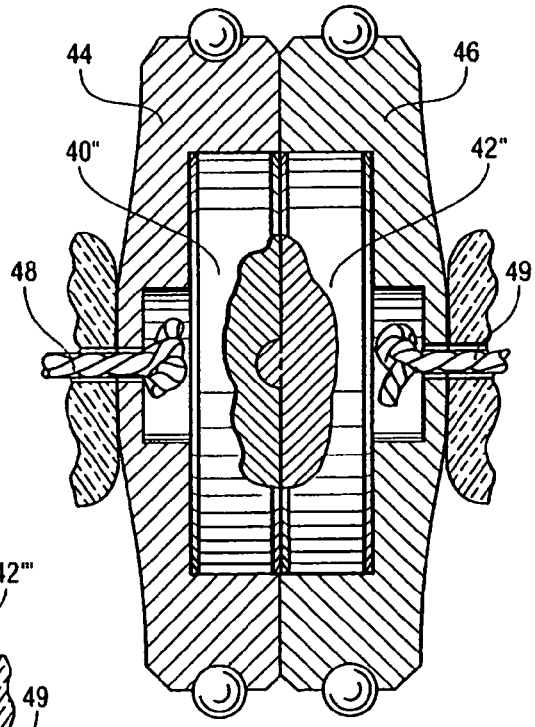
FIG. 5 is a sectional view of an alternative embodiment of the present invention.
Figure 6:
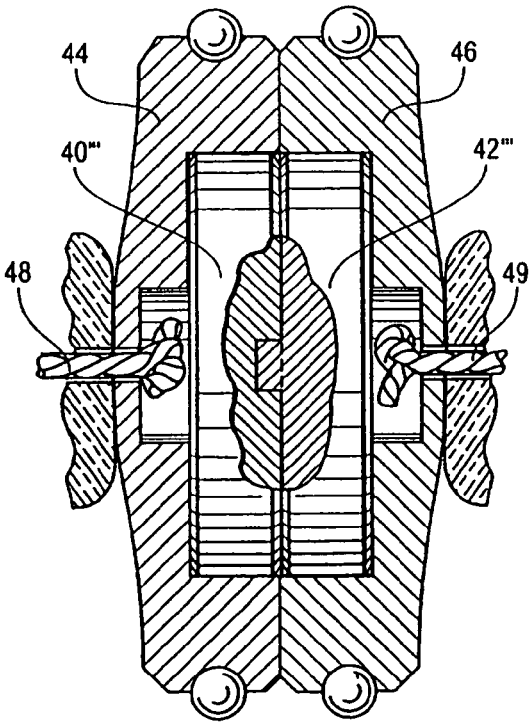
FIG. 6 is a sectional view of an alternative embodiment of the present invention.

The magnetically attractive surfaces may have strong enough magnetic qualities to sufficiently prohibit lateral movement between the receiving segment and the removable segment. Using such a strong magnet has the advantage of making the joining of the segments particularly easy. Alternatively, lateral movement of the magnetically attractive surfaces when the receiving segment is attached to the removable segment may be limited by stopping means. As shown in FIGS. 4-6, these stopping means may include the magnetically attractive surfaces being oriented with respect to each other in a tongue 42''' and groove 40''' configuration (FIG. 6) or an intermeshing teeth 40' and 42' configuration (FIG. 4), or with one surface having a divot 40'' and the opposing surface having a complementary dimple 42'' (FIG. 5).

Turning now to FIG. 3, there are illustrated two different removable segments 30 and 50 of a necklace assembly. Removable segment 30 has ends 32 and 34 and an ornamental portion 36 positioned between ends 32 and 34. Removable segment 50 has ends 52 and 54 and an ornamental portion 56 positioned between ends 52 and 54. Ornamental portions 36 and 56 may include multiple stone or decorative items, and, if desired, each being of different colors. Ornamental portion 56 is illustrated with one jewel and multiple beads of different diameters. Having different ornamental portions permits the jewelry assembly to have a different look and feel when the removable segments are swapped. Ends 32, 34, 52 and 54 each have a magnet that removably connects to a magnet on a necklace receiving segment. The magnets of ends 32, 34, 52 and 54 may be wholly or partially encased by a decorative housing. For example, ends 32 and 34 may be partially covered by roughly half of a bead, the other half of the bead encasing the magnet on the necklace segment. While beads have been used as an example, the decorative housing may be of any aesthetically pleasing ornamental design.

Multiple removable segments 30 may be joined together, and then removably attached to a receiving portion. For instance, end 32 of a segment 30 may be joined to end 54 of a segment 50. End 34 may be joined to one opposed end of a necklace segment and end 52 joined to the other opposed end of the necklace segment. Alternatively, a jewelry assembly may be formed using multiple removable segments and no necklace segment. For example, seven removable segments may be joined to form a necklace assembly.

In an alternative embodiment, the jewelry assembly is a belt. The buckle of the belt is decorative and included within the removable segment.

Figure 7:
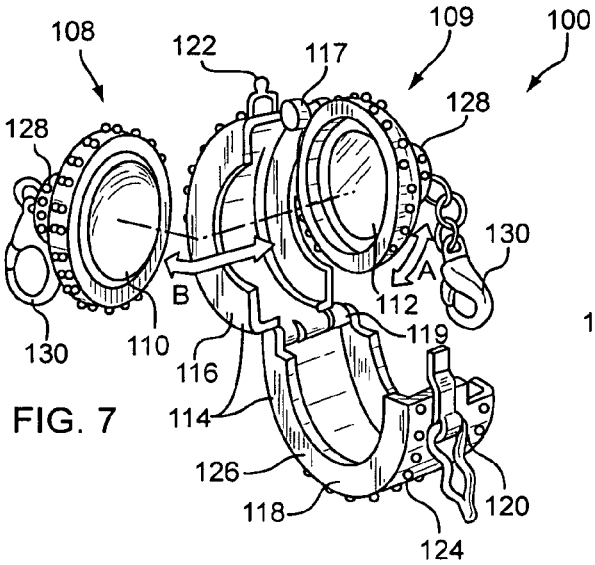
FIG. 7 is an exploded perspective view of a locking mechanism for jewelry, purses and other accessories according to the present invention.
Figure 8:
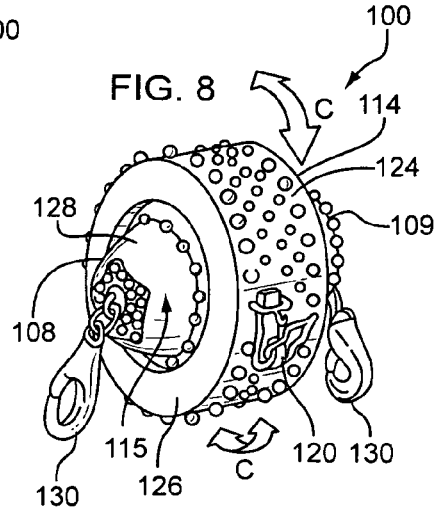
FIG. 8 is a perspective view of a locking mechanism shown in FIG. 7 illustrated in its closed position.
Figure 9:
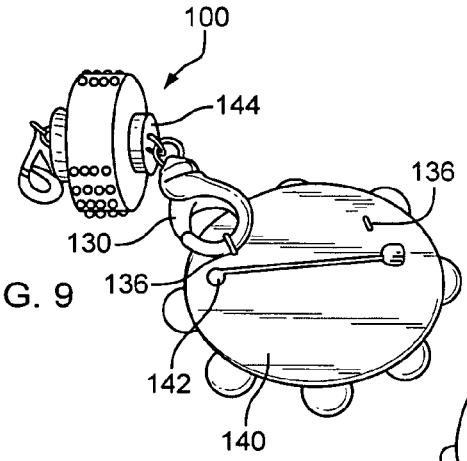
FIG. 9 is a perspective view of a brooch with a connector locking mechanism according to the present invention.

Referring now to FIGS. 7-9, it is often desirable to provide a locking mechanism 100 for the magnetic connectors discussed herein. Accordingly, as shown in FIGS. 7-11, a locking mechanism for jewelry, purses and other accessories is provided.

Figure 10:
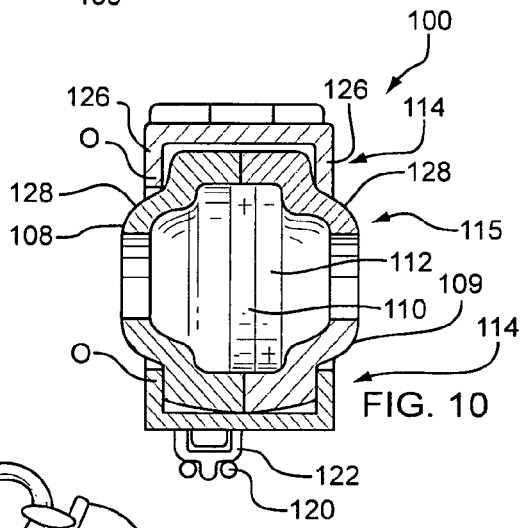
FIG. 10 is a sectional view of the magnetic connection assembly shown in FIG. 7; and, FIG. 11 is a perspective view of an accessory assembly with a connector locking mechanism according to the present invention.

The locking mechanism 100 comprises first and second magnetically attracted surfaces 110, 112 and a collar 114. With reference to FIGS. 7, 8 and 10, and as described above, the second magnetically attracted surface 112 may be magnetically coupled to the first magnetically attracted surface 110. In the example illustrated in the aforementioned figures, first and second magnetically attracted surfaces 110 and 112 are included in first and second magnetic components 108 and 109, respectively, which may be coupled to form a unitary magnetic coupling 115 comprised of magnetic components 108 and 109.

As illustrated in FIG. 7, the collar 114 is hingeably coupled to one of the magnetically attracted surfaces 110, 112. According to the present invention, the collar 114 may be hingeably coupled to either the first or the second magnetically attracted surface 110, 112 without departing from the present invention. As shown in FIGS. 7, 8 and 10, the collar 114 is preferably comprised of a first segment 116 and a second segment 118. The first segment 116 has a first end and a second end. The first end of the first segment 116 may be hingeably coupled to either of the first and second magnetically attracted surfaces 110, 112 in a suitable manner. For example, with reference to FIG. 7, the first end of first segment 116 may be hingeably coupled to the outer perimeter of second magnetic component 109 by a hinge 117. Second magnetic component 109 is rotatable relative to first segment 116 about a hinge axis running through hinge 117 in the directions indicated in FIG. 7 by arrow A. In FIG. 7, second magnetic component 109 is shown pivoted away from collar segment 116, in the counterclockwise direction indicated by arrow A, to a coupling position to permit first magnetic component 108 to be coupled to and uncoupled from second magnetic component 109 by axial movement along the dashed reference line in the directions indicated by arrow B, such axial movement being unobstructed by first segment 116. The second segment 118 also has a first end and a second end. The first end of the second segment 118 is hingeably coupled to second end of the first segment 116 about a hinge axis defined by a hinge 119. According to one embodiment, the collar 114 can include a clasp 120 disposed proximate a second end of the second segment 118, and a receiver 122 for securably receiving the clasp 120 disposed proximate the first end of the first segment 116.

It will be understood by those of skill that although one preferred embodiment provides a collar 114 with only two segments, any number of segments may be hingeably linked together to form the collar 114. It will also be understood that, although the embodiment shown in the Figures depicts an assembly with a generally circular cross-section, the magnetically attracted surfaces 110, 112 and the surrounding collar 114 may assume any suitable geometric configuration, such as for example a rectangle, octagon or any other geometric shape.

In one embodiment shown in FIGS. 7 and 8, the collar 114 is comprised of an outer wall 124 and opposed sidewalls 126 appending from the outer wall 124. According to the present invention, the outer wall 124 of the collar 114 can include a decorative element, such as ornaments, precious or semi-precious stones, or inlays. Alternatively, the surface of the outer wall 124 of the collar 114 may be textured to provide a decorative element.

Turning back to FIG. 7, it can be seen that when magnetic components 108 and 109 are coupled to form unitary magnetic coupling 115, unitary magnetic coupling 115 may pivot toward first segment 116 in the clockwise direction indicated by arrow A into a closed position adjacent first segment 116. Unitary magnetic coupling 115 is shown in this closed position in FIGS. 8 and 10. In operation, the collar 114 can be moved to and from an open position, shown in FIG. 7, and a closed position, shown in FIGS. 8 and 10. When unitary magnetic coupling 115 is in the closed position, collar 114 is itself permitted to move to and from the closed position as indicated in FIG. 8 by arrows C, in which at least a portion of the collar 114 surrounds a perimeter of the first and second magnetically attracted surfaces 110, 112, as seen in FIGS. 8 and 10. More specifically, the outer wall 124 and a portion of the appending sidewalls 126 surround the perimeter of the magnetically attracted surfaces 110, 112. As best illustrated in FIG. 10, appending sidewalls 126 thus obstruct the normal movement of magnetic component 108 away from magnetic component 109 at obstruction locations O, thereby preventing the uncoupling of unitary magnetic coupling 115. With reference to FIGS. 7 and 8, collar 114 may be moved to and from the open and closed positions without uncoupling unitary magnetic coupling 115, as the rotational opening and closing movement C of collar segments 116 and 118 is unrelated to the axial coupling and uncoupling movement B of magnetically attracted surfaces 110 and 112.

According to one embodiment, the first and second magnetically attracted surfaces 110, 112 each have a corresponding outer surface 128. For example, where magnetically attracted surfaces 110 and 112 form a part of magnetic components 108 and 109, respectively, as illustrated in FIGS. 7, 8 and 10 and discussed above, outer surface 128 may be an outer surface of each respective magnetic component 108, 109, disposed generally opposite to the corresponding magnetically attracted surface 110, 112. A separate connector 130 can be attached to the outer surface 128 associated with either or both of the first and second magnetically attracted surface 110, 112. Preferably, the connector 130 is a lobster-claw clasp. However, it is contemplated by the present invention that the connector 130 attached to the outer surfaces 128 can be any clasp suitable for securably fastening jewelry and the like.

Figure 11:
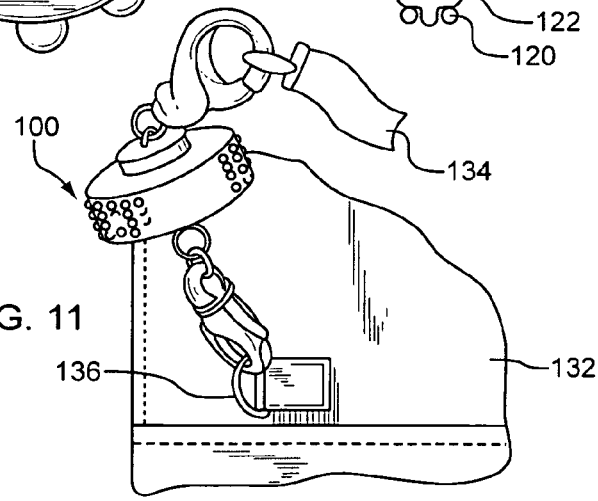

In one preferred embodiment shown in FIG. 11, the locking mechanism 100 described herein can be effectively used in connection with an accessory such as a bag 132 (e.g., a handbag or purse) with a strap 134. Preferably, the bag 132 has a first and second connection point 136 spaced apart on the body of the bag 132. The connection points are also preferably configured to receive lobster-claw clasps. Accordingly, the connection points may be loops or hooks securely attached to the bag 132. The connection points may be attached by stud fasteners, welds, or any means known in the art. It will be understood that the location of the connection points 136 is not limited to the locations shown in the FIGS. Instead, the connection points 136 may be disposed at any suitable locations on the bag 132.

Magnetically attracted surfaces are attached to each of the connection points 136. In a preferred embodiment, the magnetically attracted surfaces 110, 112 each have an outer surface with a connector 130 attached to the respective outer surface. The connector 130 is preferably a lobster-claw clasp. However, it is contemplated by the present invention, the connector 130 attached to the outer surfaces can be any clasp suitable for securely fastening jewelry and the like.

A strap 134 having a first end and a second end may be magnetically and releasably coupled to the bag 132. The strap 134 of the present invention may be a traditional purse or bag strap. Alternatively, the strap 134 may be a necklace, a belt or a bracelet as described herein. According to the present invention, a magnetically attracted surface is attachably connected proximate each of the first or second ends of the strap 134. The magnetically attracted surfaces 110, 112 are adapted for magnetic coupling to the magnetically attracted surfaces 110, 112 connected to the bag 132.

As described above, each of the magnetically attracted surfaces 110, 112 attached to the bag 132 may be secured to the magnetically attracted surfaces 110, 112 of the strap 134 by a collar 114. As shown in FIG. 11, the collar 114 can be hingeably coupled to either the magnetically attracted surface of the bag 132 or the magnetically attracted surface of the strap 134. Accordingly, when the collar magnetically attracted surface of the bag 132 is coupled to the magnetically attracted surface of the strap 134, and the collar 114 is in the closed position, the collar 114 surrounds the periphery of both the magnetically attracted surfaces 132,134 and locks the magnetic assembly in place.

The accessory assembly further includes a strap 134 having a first end and a second end. A second magnetically attracted surface is attachably connected proximate either the first or second ends of the strap 134. The second magnetically attracted surface is adapted for magnetic coupling to the first magnetically attracted surface.

The accessory assembly also has a collar 114 hingeably coupled to either the first or second magnetically attracted surfaces 110, 112. The collar 114 is operable between an open position and a closed position. When the first and second magnetically attracted surfaces are magnetically coupled one to the other, and the collar 114 is in the closed position, at least a portion of the collar 114 surrounds a perimeter of the first and second magnetically attracted surfaces 110, 112. Now will be discussed one example of one embodiment of the invention in which the locking mechanism 100 is used in connection with an accessory such as a bag 132.

According to one example, the bag has two connection points. Each of the connection points is attached via a lobster-claw clasp to one half of a magnetic assembly (i.e., one magnetically attracted surface). In one embodiment, the magnetically attracted surfaces attached to the connection points each include a collar. A strap having corresponding magnetically attracted surfaces on each opposed end is provided. Thus, the magnetically attracted surface at one end of the strap may be attached to a corresponding magnetically attracted surface attached to the first connection point, and the magnetically attracted surface at the opposed end of the strap may be attached to the corresponding magnetically attracted surfaces attached to the second connection point.

As shown in FIG. 9, the locking mechanism 100 described herein is be effectively used in connection with an accessory such as a brooch 140 or a pendant. As shown in FIG. 9 the brooch 140 preferably includes a connection point 136 on the brooch 140 provided for removably attaching the brooch 140 to a connector 130. Preferably the brooch 140 will include at least two connection points 136 so that the brooch 140 may be converted to a necklace pendant. However, it is contemplated by the present invention that the brooch 140 includes as few as a single connection point 136 or any number of additional connection points 136.

A first connector 142 is provided for removable attachment of the brooch 140 to an object, such as a garment, draperies or any other surface on which a brooch 140 may be worn or adorned. Preferably the first connector 142 is of the pivotable straight pin and clasp type. However, it will be understood that the first connector 142 may be any type of connecter suitable for affixing a brooch 140 to an object.

The brooch 140 also includes a second connector 144 comprising a magnetically attracted surface. The second connector 144 is removably attached to the first connection point, and is adapted for magnetic coupling to a corresponding magnetically attracted surface. The magnetically attracted surface is preferably attached to the connection point by a lobster-claw clasp. However, as contemplated by the present invention, the connector attached to the connection point can be any clasp suitable for securely fastening jewelry and the like.

As shown in FIG. 9 a collar is hingeably attached to the second connector 144 and is operable between an open position and a closed position. When the second connector 144 is magnetically coupled to a corresponding magnetically attracted surface, and the collar is in the closed position, at least a portion of the collar surrounds a perimeter of the second connector 144 and the corresponding magnetically attracted surface.

As used herein, the terms "first," "second," "third," etc. are for illustrative purposes only and are not intended to limit the embodiments in any way. Additionally, the term "plurality" as used herein is intended to indicate any number greater than one, either disjunctively or conjunctively as necessary, up to an infinite number.

While the specific embodiments have been illustrated and described, numerous modifications come to mind without significantly departing from the spirit of the invention, and the scope of protection is only limited by the scope of the accompanying Claims.

What is claimed is:

1. A locking mechanism for jewelry, purses and other accessories, the locking mechanism comprising:

a first magnetic component comprising a first magnetically attracted surface and a first outer surface generally opposite the first magnetically attracted surface;

a second magnetic component comprising a second magnetically attracted surface and a second outer surface generally opposite the second magnetically attracted surface, the second magnetically attracted surface being adapted for magnetic coupling to the first magnetically attracted surface;

a hinged collar having a first segment and a second segment, the second segment rotatably coupled to the first segment by a first hinge defining a first hinge axis and to the first magnetic component by a second hinge defining a second hinge axis that is at least substantially parallel to the first hinge axis, and the first and second segments of the hinged collar being rotatable relative to each other about the first hinge axis to and from an open position and a closed position;

when the first and second magnetically attracted surfaces are magnetically coupled one to the other and the hinged collar is in the closed position, at least a portion of the hinged collar overlaps a perimeter of the second outer surface to restrain movement of the second magnetic component away from the first magnetic component in a direction generally parallel to the hinge axes and to at least substantially prevent the magnetically attracted surfaces from being uncoupled, and when the first and second magnetically attracted surfaces are magnetically coupled to each other, the first and second segments of the hinged collar are movable to and from the open and closed positions without uncoupling the magnetically attracted surfaces.

2. The locking mechanism of claim 1, further comprising:

a clasp connected to one of the first and second segments of the hinged collar; and, a receiver connected to the other segment of the hinged collar, the receiver being provided to securably receive the clasp when the hinged collar is in the closed position, to prevent the hinged collar from being opened without the clasp being removed from the receiver.

3. The locking mechanism of claim 1, the hinged collar further comprising an at least substantially cylindrical outer wall and opposed, annular sidewalls appending from the outer wall, the annular sidewalls are at least substantially parallel to each other and at least substantially orthogonal to a cylindrical axis of the outer wall, and said at least a portion of the hinged collar that overlaps the perimeter of the second outer surface when the hinged collar is in the closed position comprises at least a portion of the annular sidewalls.

4. The locking mechanism of claim 3, wherein the outer wall of the hinged collar includes a decorative element.

5. The locking mechanism of claim 1, wherein one of the magnetically attracted surfaces is of positive polarity and the other of the magnetically attracted surfaces is of negative polarity.

6. The locking mechanism of claim 5, further comprising a connector that is a lobster-claw clasp attached to at least one of the outer surfaces of the first and second magnetic components.

7. A locking mechanism for jewelry, purses and other accessories, the locking mechanism comprising:

a first magnetic component comprising a first magnetically attracted surface and a first outer surface generally opposite the first magnetically attracted surface;

a second magnetic component comprising a second magnetically attracted surface and a second outer surface generally opposite the second magnetically attracted surface, the second magnetically attracted surface being adapted for magnetic coupling to the first magnetically attracted surface to form a unitary magnetic coupling comprising the first and second magnetic components; and a hinged collar having a first segment and a second segment, the second segment rotatably coupled to the first segment by a first hinge defining a first hinge axis, the first hinge axis being at least generally orthogonal to the first magnetically attracted surface;

the first and second segments of the hinged collar being rotatable relative to each other about the first hinge axis to and from an open position and a closed position and the unitary magnetic coupling being rotatable to and from a closed position, the closed position being adjacent the second segment of the hinged collar, the hinged collar being closable from the open position to the closed position when the unitary magnetic coupling is in the closed position, and when the unitary magnetic coupling is in the closed position and the hinged collar is in the closed position, the segments of the hinged collar cooperate to form a generally cylindrical outer wall surrounding the magnetically attracted surfaces and to form a generally annular sidewall extending radially inwardly from the generally cylindrical outer wall, and at least a portion of the generally annular sidewall overlapping at least a portion of the second magnetic component to obstruct axial movement of the second magnetic component away from the first magnetic component and to at least substantially prevent uncoupling of the unitary magnetic coupling.

8. The locking mechanism of claim 7, wherein the first and second segments of the hinged collar are movable to and from the open and closed positions without uncoupling the unitary magnetic coupling.

9. The locking mechanism of claim 7, further comprising:

a clasp connected to one of the first and second segments of the hinged collar; and a receiver connected to the other segment of the hinged collar, the receiver configured to securely receive the clasp when the hinged collar is in the closed position to prevent the hinged collar from being opened without the clasp being removed from the receiver.

10. The locking mechanism of claim 7, wherein, when the hinged collar is in the open position and the first magnetic component is in the closed position, at least a portion of the second segment of the hinged collar obstructs a pathway normal to the first magnetically attracted surface to substantially prevent moving the second magnetic component toward the first magnetic component along the normal pathway to couple the second magnetically attracted surface to the first magnetically attracted surface, and wherein the first magnetic component is rotatable relative to the second segment of the hinged collar to and from a coupling position in which the normal pathway is at least substantially unobstructed by the second segment of the hinged collar and the second magnetic component may be moved toward the first magnetic component along the normal pathway to couple the second magnetically attracted surface to the first magnetically attracted surface.

11. The locking mechanism of claim 7, wherein the generally annular sidewall has an inner perimeter defining an opening, and the second magnetic component further comprises a connector that is a lobster-claw clasp attached to a portion of the outer surface of the second magnetic component that aligns with the opening when the unitary magnetic coupling is in the closed position and the hinged collar is in the closed position.

12. The locking mechanism of claim 7 further comprising the second segment rotatably coupled to the first magnetic component by a second hinge defining a second hinge axis that is at least substantially parallel to the first hinge axis.

* * * * *